US005620318A

United States Patent [19]

Tsai

[11] Patent Number: 5,620,318

[45] Date of Patent: Apr. 15, 1997

[54] FUEL GAS PRESS CONTROL DEVICE OF A GAS TORCH

[76] Inventor: Chin-Lin Tsai, 3F, No. 94, Sec. 4, Chun Hsin Rd., San Chung City, Taipei Hsien, Taiwan

[21] Appl. No.: 691,179

[22] Filed: Aug. 1, 1996

[51] Int. Cl.[6] ..... F23D 14/28

[52] U.S. Cl. ..... 431/344; 126/407; 126/414

[58] Field of Search ..... 431/255, 266, 431/344, 345, 277, 354; 126/401, 407, 413, 414, 405

[56] References Cited

U.S. PATENT DOCUMENTS

| | | | |
|---|---|---|---|
| 4,315,732 | 2/1982 | Rowbottam et al. | 431/344 |
| 4,419,072 | 12/1983 | Nakagawa | 431/344 |
| 4,502,465 | 3/1985 | Yoshinaga et al. | 431/255 |
| 4,699,123 | 10/1987 | Zaborowski | 126/409 |
| 5,304,060 | 4/1994 | Lin | 431/255 |
| 5,466,149 | 11/1995 | Tsai | 126/407 |
| 5,564,918 | 10/1996 | Lin | 431/255 |
| 5,573,393 | 11/1996 | Tsai | 431/255 |

*Primary Examiner*—James C. Yeung
*Attorney, Agent, or Firm*—Bucknam and Archer

[57] ABSTRACT

A fuel gas press control device of a gas torch, including a switch mounted on the shell of the gas torch and moved between a circular hole and a sliding slot, a retaining knob mounted in a hole in the switch, a pressure rod fastened to the switch and forced by it to press on the gas lever of a butane well, and a spring mounted around the retaining knob and stopped between a collar of the retaining knob and a horizontal projecting plate of the switch, the spring forcing the collar of the retaining knob into the circular hole of the shell to lock the switch is the operative position when the switch is moved to the circular hole of the shell to force the pressure rod into engagement with the gas lever of the butane well.

4 Claims, 2 Drawing Sheets

FUEL GAS PRESS CONTROL DEVICE OF A GAS TORCH

BACKGROUND OF THE INVENTION

The present invention relates to gas torches, and relates more particularly to the fuel gas press control device of a gas torch which has lock means to lock the fuel gas control switch in the operative position.

A variety of handy gas torches have been disclosed for melting or welding things. These gas torches commonly have a control means adapted for controlling the flow rate of fuel gas. U.S. Pat. No. 5,304,060 discloses a typical structure of a fuel gas press control device for controlling the flow rate of fuel gas. When in use, the fuel gas press control device must be maintained depressed so that fuel gas is continuously driven out of the nozzle tube and burned. Because the fuel gas press control device must be constantly maintained depressed during the operation, the fingers will get tired quickly. If the hand is released from the fuel gas press control device, fuel gas is immediately stopped. U.S. Pat. No. 5,531,592, issued to the present inventor, disclosed a handy gas torch which uses a disposable cigarette lighter as the fuel source. The fuel gas control device of this structure of gas torch comprises a torch nozzle connected to the fuel gas nozzle of the cigarette lighter by a nozzle tube and a connecting tube assembly, a slide switch, a pressure rod driven by the slide switch to press the push button of the cigarette lighter in opening the fuel gas nozzle.

SUMMARY OF THE INVENTION

The present invention provides a fuel gas press control device for a gas torch, comprising: a shell having an opening, a circular hole, and a sliding slot communicating between the opening and the circular hole; a switch mounted on the shell and moved in the sliding slot, the switch comprising a horizontal top plate disposed above the shell and having a vertical through hole, a vertical bottom block disposed below the shell and having a horizontal through hole, a neck connected between the horizontal top plate and the vertical bottom block and inserted through the opening of the shell into the circular hole and sliding slot thereof, a horizontal projecting plate perpendicularly raised from the vertical bottom block above the elevation of the horizontal through hole of the vertical bottom block and having a vertical through hole vertically aligned with the vertical through hole of the horizontal top plate, a pressure rod assembly mounted in the horizontal through hole of the vertical bottom block and adapted for pressing on a gas lever of a butane well; a retainer knob having a knob head inserted through the vertical through hole of the horizontal top plate of the switch from the bottom, a rod-like knob body facing the vertical through hole of the horizontal projecting plate of the switch, and a collar disposed between the knob head and the rod-like knob body and stopped below the shell; and a compression spring mounted around the rod-like knob body of the retaining knob and connected between the horizontal top plate of the switch and the horizontal projecting plate thereof to impart an upward pressure to the collar; wherein when the switch is moved along the sliding slot of shell to the circular hole thereof, the collar of the retaining knob is forced upward into the circular hole of shell by the compression spring, causing a sound to be produced, and at the same time the pressure rod assembly is pressed on the gas lever of the butane well to release fuel gas; when the knob head of the retaining knob is pressed down to lower the collar of the retaining knob from the circular hole of the shell, the switch is allowed to be pushed backwards from the circular hole of the shell to the sliding slot thereof, permitting the pressure rod assembly to be moved away from the gas lever of the butane well to stop fuel gas.

DETAILED DESCRIPTION OF THE PREFERRED EMBODIMENT

Figure 1:
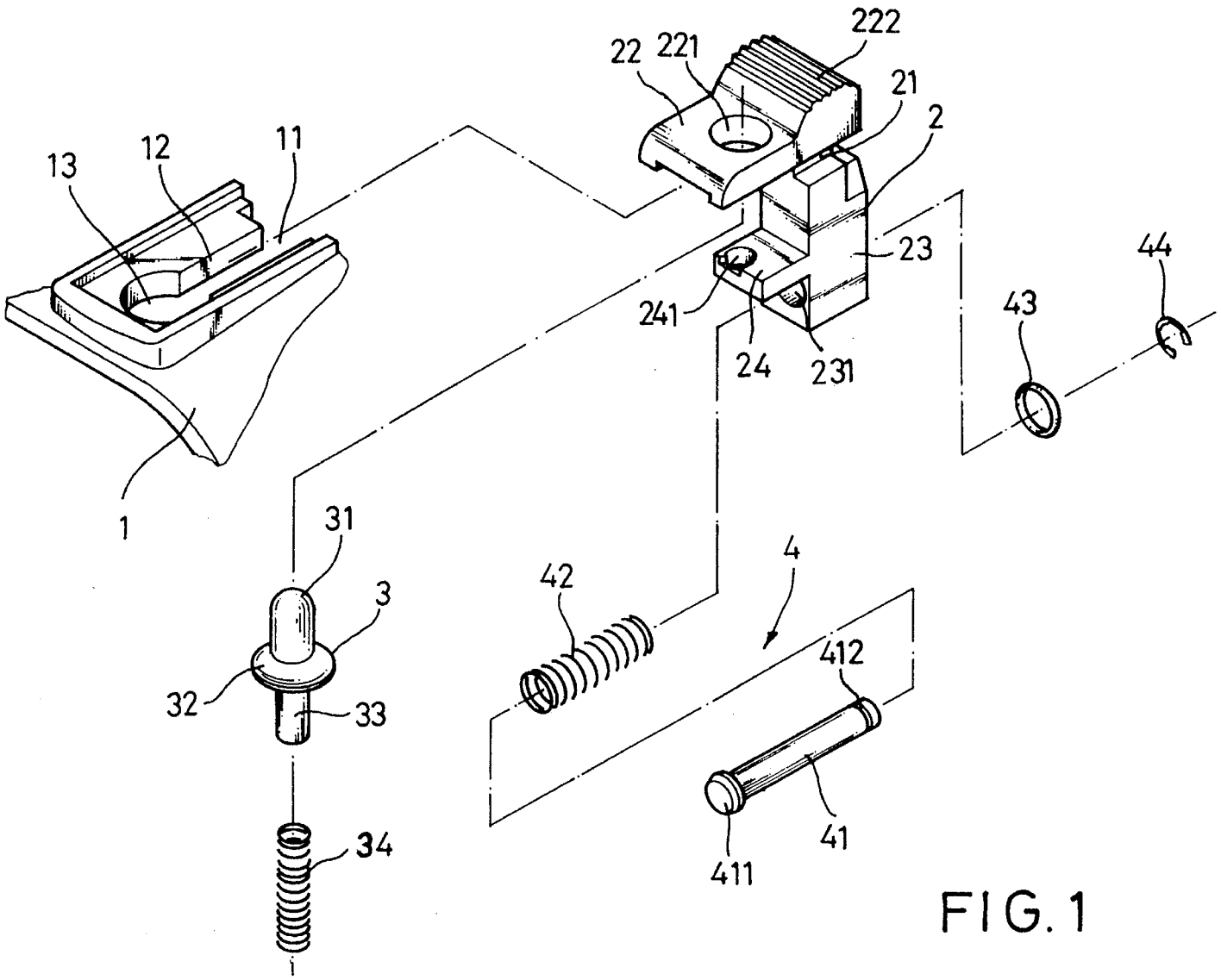
FIG. 1 is an exploded view of a fuel gas press control device according to the present invention.
Figure 2:
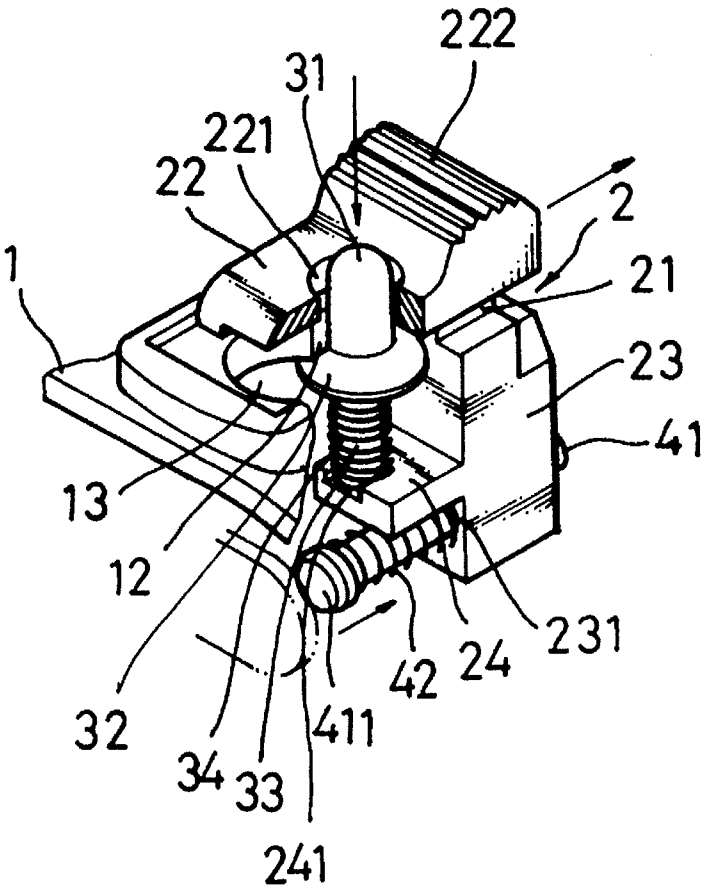
FIG. 2 is an elevational view of the fuel gas press control device shown in FIG. 1.

Referring to FIGS. 1 and 2, a fuel gas press control device in accordance with the present invention is adapted for mounting on the shell 1 of a gas torch (not shown), comprised of a switch 2, a retaining knob 3, and a pressure rod assembly 4. The shell 1 has an opening 11, a circular hole 13, and a sliding slot 12 communicating between the opening 11 and the circular hole 13. The switch 2 comprises a horizontal top plate 22 having a vertical through hole 221 and an arched push portion 222, a vertical bottom block 23 having a horizontal through hole 231, a neck 21 connected between the horizontal top plate 22 and the vertical bottom block 23 and inserted through the opening 11 into the circular hole 13 and the sliding slot 12, a horizontal projecting plate 24 perpendicularly raised from the vertical bottom block 23 above the horizontal through hole 231 of the vertical bottom block 23 and having a vertical through hole 241 vertically aligned with the vertical through hole 221 of the horizontal top plate 22. The retainer knob 3 comprises a knob head 31 inserted through the vertical through hole 221 of the horizontal top plate 22 of the switch 2 from the bottom, a rod-like knob body 33 facing the vertical through hole 241 of the horizontal projecting plate 24 of the switch 2, and a collar 32 disposed between the knob head 31 and the rod-like knob body 33 and stopped below the shell 1. A compression spring 34 is mounted around the rod-like knob body 33 and connected between the horizontal top plate 22 and the horizontal projecting plate 24 to impart an upward pressure to the collar 32, causing the collar 32 to be stopped against the bottom side of the horizontal top plate 22. When the retaining knob 3 is installed, the top end of the knob head 31 is disposed in flush with the arched push portion 222 of the horizontal top plate 22. When the knob head 31 is depressed, the rod-like knob body 33 is lowered to partially insert into the vertical through hole 241 of the horizontal projecting plate 24 of the switch 2. When the knob head 31 is released from the hand, the compression spring 34 automatically pushes the retaining knob 3 back to its former position. The pressure rod assembly 4 comprises a pressure rod 41 inserted through the horizontal through hole 231 of the vertical bottom block 23 of the switch and having a head 411 at one end and an annular groove 412 at an opposite end around the periphery, a washer 43 mounted around the pressure rod 41 and stopped at the head 411, a compression spring 42 mounted around the pressure rod 41 and stopped between the washer 43 and the vertical bottom block 23, and a clamp 44 fastened to the annular groove 412 to secure the pressure rod 41 to the vertical bottom block 23 of the switch 2.

Referring to FIG. 2, when the retaining knob 3, the pressure rod assembly 4, and the switch 2 are assembled, the neck 21 of the switch 2 are inserted through the opening 11 into the sliding slot 12, and then the opening 11 of the shell 1 is coupled to another part, for example, the top cover of the gas torch (not shown) to prohibit the switch 2 from escaping out of the shell 1. In FIG. 2, the fuel gas press control device is maintained in the non-operative position, in which the knob head 31 of the retaining knob 3 is disposed in flush with the vertical through hole 221 of the horizontal top plate 22 of the switch 2.

Figure 3:
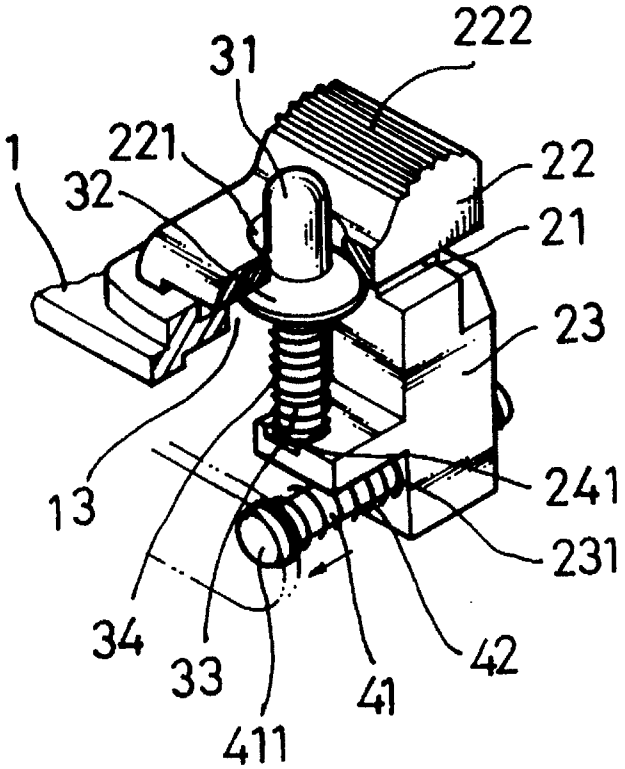
FIG. 3 is similar to FIG. 2 but showing the press button depressed.

Referring to FIG. 3, when the press portion 222 of the horizontal top plate 22 is pushed inwards from the sliding slot 12 to the circular hole 13, the collar 32 of the retaining knob 3 is forced into alignment with the circular hole 13, the knob head 31 is forced out of the vertical through hole 221 of the horizontal top plate 22, causing a click sound to be produced, and at the same time the pressure rod 41 is forced into the operative position and pressed on the gas lever of the butane well as shown in phantom line illustrated in FIGS. 2 and 3. When not in use, the retaining knob 3 is pressed down to lower the collar 32 from the circular hole 13 for permitting the switch 2 to be pushed outwards along the sliding slot 12. When the switch 2 is moved back to its former position, the pressure rod 41 is released from the gas lever of the butane well as shown in phantom line illustrated in FIGS. 2 and 3.

While only one embodiment of the present invention has been shown and described, it will be understood that various modifications and changes could be made without departing from the spirit and scope of the invention.

What the invention claimed is:

1. A fuel gas press control device comprising:

a shell having an opening, a circular hole, and a sliding slot communicating between said opening and said circular hole;

a switch mounted on said shell and moved in said sliding slot, said switch comprising a horizontal top plate disposed above said shell and having a vertical through hole, a vertical bottom block disposed below said shell and having a horizontal through hole, a neck connected between said horizontal top plate and said vertical bottom block and inserted through the opening of said shell into the circular hole and sliding slot thereof, a horizontal projecting plate perpendicularly raised from said vertical bottom block above the elevation of the horizontal through hole of said vertical bottom block and having a vertical through hole vertically aligned with the vertical through hole of said horizontal top plate, a pressure rod assembly mounted in the horizontal through hole of said vertical bottom block and adapted for pressing on a gas lever of a butane well;

a retainer knob having a knob head inserted through the vertical through hole of said horizontal top plate of said switch from the bottom, a rod-like knob body facing the vertical through hole of said horizontal projecting plate of said switch, and a collar disposed between said knob head and said rod-like knob body and stopped below said shell; and a compression spring mounted around the rod-like knob body of said retaining knob and connected between the horizontal top plate of said switch and the horizontal projecting plate thereof to impart an upward pressure to said collar;

wherein when said switch is moved along the sliding slot of shell to the circular hole thereof, the collar of said retaining knob is forced upward into the circular hole of said shell by said compression spring, causing a sound to be produced, and at the same time said pressure rod assembly is pressed on the gas lever of said butane well to release fuel gas; when the knob head of said retaining knob is pressed down to lower the collar of said retaining knob from the circular hole of said shell, said switch is allowed to be pushed backwards from the circular hole of said shell to the sliding slot thereof, permitting said pressure rod assembly to be moved away from the gas lever of said butane well to stop fuel gas.

2. The fuel gas press control device of claim 1 wherein said pressure rod assembly comprises a pressure a pressure rod inserted through the horizontal through hole of said vertical bottom block of said switch and having a head at one end and an annular groove at an opposite end around the periphery, a compression spring mounted around said pressure rod and stopped between the head of said pressure rod and the vertical bottom block of said switch, and a clamp fastened to the annular groove of said pressure rod to secure said pressure rod to the vertical bottom block of said switch.

3. The fuel gas press control device of claim 2 wherein said pressure rod assembly further comprises a washer mounted around said pressure rod and stopped between the head of said pressure rod and the compression spring of said pressure rod assembly.

4. The fuel gas press control device of claim 1 wherein the horizontal top plate of said switch has an arched press portion raised from a top side thereof for pushing with the hand.

* * * * *